US007992544B2

(12) United States Patent
Hanneke

(10) Patent No.: US 7,992,544 B2
(45) Date of Patent: Aug. 9, 2011

(54) FIXING ELEMENT FOR AN EXPANSION SLEEVE

(75) Inventor: Juergen Hanneke, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 194 days.

(21) Appl. No.: 12/522,435

(22) PCT Filed: Dec. 6, 2007

(86) PCT No.: PCT/EP2007/063447

§ 371 (c)(1),
(2), (4) Date: Jul. 8, 2009

(87) PCT Pub. No.: WO2008/083883

PCT Pub. Date: Jul. 17, 2008

(65) Prior Publication Data

US 2010/0043756 A1 Feb. 25, 2010

(30) Foreign Application Priority Data

Jan. 10, 2007 (DE) ..... 10 2007 001 549

(51) Int. Cl.
*F02M 61/14* (2006.01)

(52) U.S. Cl. ..... 123/470

(58) Field of Classification Search ..... 123/467, 123/470

See application file for complete search history.

(56) References Cited

U.S. PATENT DOCUMENTS

| | | | | |
|---|---|---|---|---|
| 6,481,421 | B1 * | 11/2002 | Reiter | 123/470 |
| 6,886,539 | B2 * | 5/2005 | Perras | 123/470 |
| 6,928,985 | B2 * | 8/2005 | Boecking | 123/467 |
| 7,281,521 | B2 * | 10/2007 | Neumaier | 123/470 |
| 7,377,264 | B2 * | 5/2008 | Buehner | 123/470 |
| 2003/0164158 | A1 | 9/2003 | Reiter | |
| 2008/0000452 | A1 | 1/2008 | Ricci | |

FOREIGN PATENT DOCUMENTS

| | | | |
|---|---|---|---|
| DE | 10235445 | A1 | 2/2003 |
| DE | 102006018194 | A1 | 10/2007 |
| EP | 1862669 | A1 | 12/2007 |
| FR | 2890123 | A1 | 3/2007 |
| WO | 02066827 | A1 | 8/2002 |

* cited by examiner

*Primary Examiner* — Hai H Huynh
(74) *Attorney, Agent, or Firm* — Ronald E. Greigg

(57) ABSTRACT

The invention relates to a fuel injector which has a retaining body and an injection nozzle nut. An expansion sleeve, which can be supplied with hydraulic fluid, is provided around the periphery of the fuel injector, in particular around the periphery of the retaining body. The expansion sleeve includes at least one pocket-type recess, which can be supplied with hydraulic fluid.

10 Claims, 1 Drawing Sheet

FIXING ELEMENT FOR AN EXPANSION SLEEVE

CROSS-REFERENCE TO RELATED APPLICATION

This application is a 35 USC 371 application of PCT/EP2007/063447 filed on Dec. 6, 2007.

BACKGROUND OF THE INVENTION

1. Field of the Invention 0 865 A1 has disclosed a solenoid valve for controlling the fuel pressure in a control chamber of an injection valve, for example a common rail/high-pressure reservoir injection system. The influence of the fuel pressure prevailing in the control chamber is used to control a lifting motion of a valve piston that opens or closes an injection opening of the injection valve. The solenoid valve includes an electromagnet, a movable armature, and a valve member, which is moved by the armature, is acted on in the closing direction by a valve closing spring, and cooperates with the valve seat of the solenoid valve, thus controlling the flow of fuel out of the control chamber.

2. Description of the Prior Art

Depending on the specific installation, fuel injectors are fastened to the cylinder head, for example by means of a clamping bracket or the like, depending on the configuration of the cylinder head of the engine manufacturer.

Previously used clamping bracket designs with which fuel injectors are fastened in the cylinder head region of internal combustion engines lead to the tolerance-induced introduction of transverse forces and therefore to a tilting of the fuel injector in its receiving bore. This in turn results in functional disadvantages that are reflected in the combustion of the fuel and in an increased wear on mechanical components in the injector itself.

SUMMARY OF THE INVENTION

According to the invention, the injector body of the fuel injector is provided with a hydraulic line to permit it to be acted on by means of a hydraulic fluid, a pressure piston, and an expansion sleeve. If the pressure piston is screwed into the injector body, then the hydraulic fluid stored in the line system for the clamping medium is displaced from the clamping line system. The displaced fluid deforms the expansion sleeve, which has at least one pocket-shaped, thin-walled region and, through its thin-wailed design, allows the hydraulic fluid to elastically deform the wall of the expansion sleeve. The expansion sleeve preferably has two pocket-shaped, thin-walled regions that are situated one above the other, viewed in the axial direction of the expansion sleeve. The two pocket-shaped regions ensure that the injector body of the fuel injector is uniformly centered in relation to the center of its receiving bore in the cylinder head region. If the pressure on the expansion region, i.e. the thin-walled region of the expansion sleeve, is further increased by the pressure piston being screwed further into the injector body, then this results in a radial clamping of the expansion sleeve in the bore of the cylinder head since the outsides of the expansion sleeve rest against the inner walls of the receiving bore of the relevant fuel injector in the cylinder head of the internal combustion engine. This radial clamping can be increased through further displacement of hydraulic fluid from the clamping line system embodied in the injector body until it is easily possible to withstand the axial force that the combustion pressure exerts on the fuel injector.

In order to disconnect the connection of the fuel injector proposed according to the invention, the pressure piston that acts on the clamping line system for the hydraulic medium in the injector body of the fuel injector is screwed back out from the injector body, thus relieving the pressure in the clamping line system in which the hydraulic fluid is stored. If it is not possible to embody two pocket-shaped, thin-walled regions in the expansion sleeve, e.g. for space reasons, then the radial prestressing force can be produced by embodying a radial prestressing region through the use of a second guide of the fuel injector in the region of the nozzle retaining nut. The pressure that the expansion sleeve exerts on the inner circumference surface of the cylinder head bore makes it possible to eliminate the otherwise customary sealing elements on the injector body or in the cylinder head cover. The embodiment proposed according to the invention does not require any additional components such as brackets, flanges, or the associated fastening screws. The distance between the individual cylinders of the internal combustion engine can be reduced to a minimum. The space can be used for other components such as cams of the cam shaft, valves, valve springs for the hydraulic valves, or can be used for the implementation of a hydraulic valve-play compensation as well as for other technical refinements that are used in internal combustion engines.

BRIEF DESCRIPTION OF THE DRAWINGS

The invention will be described in greater detail below in conjunction with the drawings.

DESCRIPTION OF THE PREFERRED EMBODIMENTS

Figure 1:
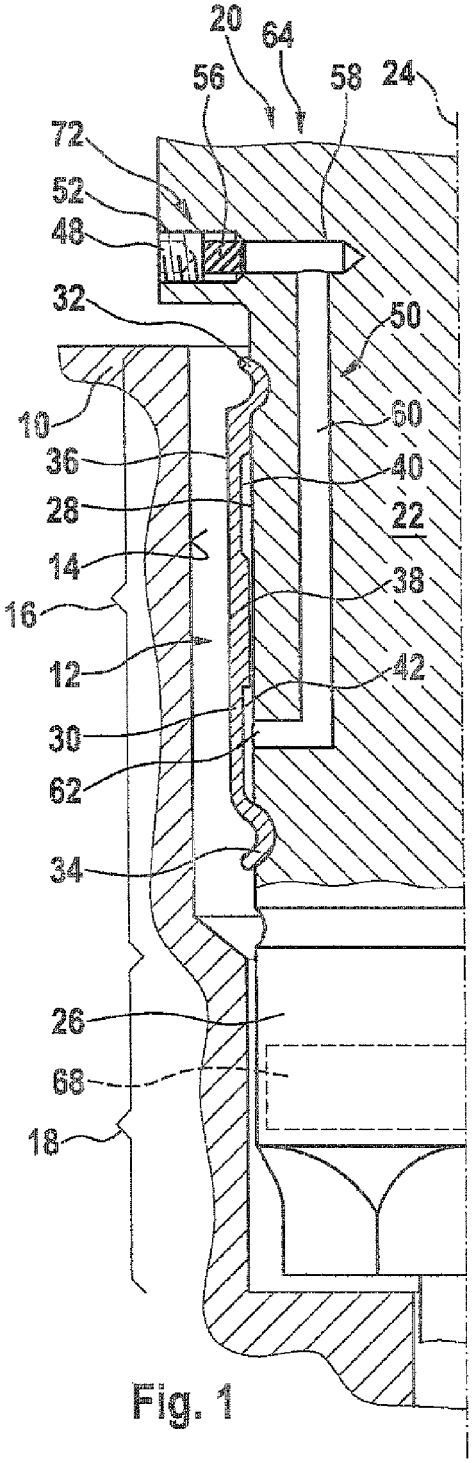
FIG. 1 shows a section through the fuel injector proposed according to the invention, with the expansion sleeve in the unclamped state.

FIG. 1 shows the fuel injector proposed according to the invention, inserted into a receiving bore in the cylinder head of an internal combustion engine.

FIG. 1 shows a sectionally depicted cylinder head 10 in which a receiving bore 12 extends. The receiving bore 12 has an inner bore wall 14 with a first bore section 16 and a second bore section 18. The first bore section 16 has an enlarged diameter in comparison to the second bore section 18 in the material of the cylinder head 10 above a combustion chamber of the internal combustion engine.

A fuel injector 20 is mounted in the receiving bore 12. The fuel injector 20 has a holding body 22; the axis of the fuel injector 20 is labeled with the reference numeral 24. In addition to the holding body 22, the fuel injector 20 includes a nozzle retaining nut 26 whose circumference surface is labeled with the reference numeral 28.

In the depiction in FIG. 1, an expansion sleeve 30 in the unclamped state rests against the circumference surface 28 of the holding body 22 of the fuel injector 20. The expansion sleeve 30 is attached, preferably integrally joined, to the to the circumference surface 28 of the holding body 22 of the fuel injector 20 at a first attachment site 32 and a second attachment site 34. The embodiment of the first attachment site 32 and the second attachment site 34 in the form of integral attachment sites achieves a pressure-tight attachment of the sleeve 30 to the circumference surface 28 of the holding body 22.

FIG. 1 also shows that a clamping line 50 extends in the holding body 22 of the fuel injector 20. The clamping line 50 includes a blind bore 58 and a conduit 60 extending parallel to the axis 24 of the fuel injector 20, which opens out at a mouth 62 on the circumference surface 28 of the holding body 22. The clamping line 50, which includes at least the above-mentioned components, is filled with a hydraulic fluid. One end of the clamping line 50 opens out at the mouth 62 on the circumference surface 28 of the holding body 22 of the fuel injector 20; at the other end, the clamping line 50 according to the depiction in FIG. 1 includes a pressure piston 48 embodied, for example, in the form of a grub screw or the like. The pressure piston 48 can, for example, be accommodated in the form of the above-mentioned grub screw in the blind bore 58 of the clamping line 50. The pressure piston 48 includes a sealing element 56 that prevents hydraulic fluid from the clamping line 50 from escaping into the environs. In the depiction in FIG. 1, the pressure piston 48 is in a screwed-out position indicated by the reference numeral 72, i.e. the end surface of the pressure piston 48 is flush with the outer circumference surface of the holding body 22 of the fuel injector 20.

The depiction in FIG. 1 also shows that the expansion sleeve 30, which is attached to the circumference surface 28 of the holding body 22 at the first attachment site 32 and the second attachment site 34, has at least one pocket-shaped recess, preferably a first pocket-shaped recess 40 and a second pocket-shaped recess 42. The two pocket-shaped recesses 40 and 42 in the depiction in FIG. 1 are situated parallel to the axis 24 of the holding body 22, viewed in the axial direction.

The expansion sleeve 30 mounted on the circumference surface 28 of the holding body 22 has an inner surface 38 spaced a small distance apart from the circumference surface 28 of the holding body 22 and permits an overflow of hydraulic fluid, for example from the second pocket-shaped recess 42 into the first pocket-shaped recess 40 via an annular gap between the inner surface 38 and the circumference surface 28. Consequently, when the hydraulic fluid exits the mouth 62, this hydraulic fluid acts on the entire inner surface 38 of the expansion sleeve 30 fastened to the circumference surface 28.

The depiction in FIG. 1 also shows that the fuel injector 20 has a guide surface 68 on the nozzle retaining nut 26 underneath the holding body 22. The guide surface 68 serves to guide and center the fuel injector 20 inside the receiving bore 12 when the latter is embodied as shortened for space and installation reasons and the expansion sleeve 30 has only one of the pocket-shaped recesses 40 or 42 inside the first bore section 16. In this case, using the design proposed according to the invention makes it possible to achieve a fixing and centering of the fuel injector 20 in the receiving bore 12 through an exertion of pressure on the expansion sleeve 30, even with only one pocket-shaped recess 40 or 42, because its centering in the receiving bore 12 is assured by the guide surface 68 on the circumference of the nozzle retaining nut 26.

Figure 2:
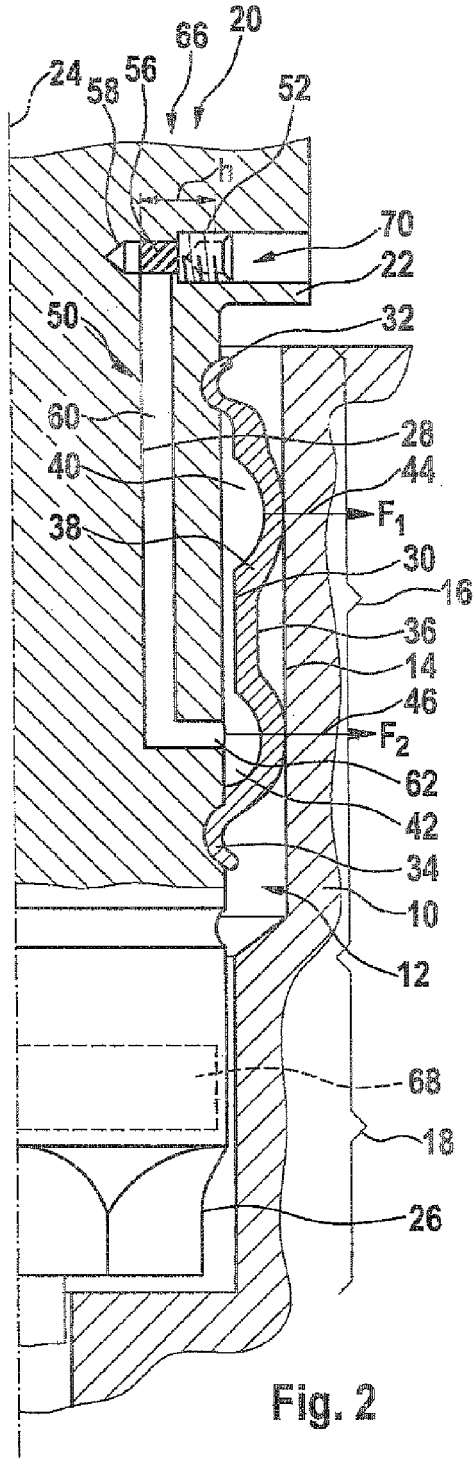
FIG. 2 shows the fuel injector with the expansion sleeve accommodated on the injector body in the clamped state.

In the depiction according to FIG. 2, the fuel injector proposed according to the invention is shown in a state in which it is clamped into the cylinder head.

In the depiction in FIG. 2, the pressure piston 48 is shown in the state 70 in which it is screwed into the blind bore 58. By contrast with the position of the pressure piston 48 in FIG. 1, which shows the unclamped state 64, the pressure piston 48 has now been screwed into the blind bore 58 by a visible travel distance. Because of this, the hydraulic fluid stored in the clamping line 50 is displaced from the blind bore 58 via the conduit 60 and comes out of the mouth 62 on the circumference surface 28 of the holding body 22 inside the expansion sleeve 30. Depending on the travel distance 54 by which the pressure piston 48 is moved into the blind bore 58, a larger or smaller amount of hydraulic fluid comes out of the mouth 62 and acts on the inner surface 38 of the expansion sleeve 30. Because of the embodiment of the first attachment site 32 and the second attachment site 34 in the form of integral attachment sites, the hydraulic fluid does not flow into the receiving bore 12 but instead causes a deformation of the expansion sleeve 30. It is deformed, for example, in the way shown in FIG. 2, which represents the clamped state 66. Because of the deformation of the first pocket-shaped recess 40 and the second pocket-shaped recess 42 of the expansion sleeve 30, the outside 36 of the expansion sleeve 30 rests against the bore wall 14 of the receiving bore 12.

As is also clear from the depiction in FIG. 2, the deformation of the expansion sleeve 30 in the radially outward direction causes a first clamping force $F_1$ to act in the region of the first pocket-shaped recess 40 of the expansion sleeve 30 and the deformation of the wall of the expansion sleeve 30 causes a second clamping force ($F_2$) to act in the region of the second pocket-shaped recess 42. The radially acting clamping forces 44 and 46 ($F_1$, $F_2$) produce an axially acting holding force that fixes the fuel injector 20 with its holding body 22 in the receiving bore 12 of the cylinder head 10. Depending on the exertion of pressure on the inner surface 38 of the expansion sleeve 30, an axial holding force can be produced, which counteracts the compressive force acting in the compression chamber of the internal combustion engine and exceeds it by enough that the expansion sleeve 30 fixed against the circumference surface 28 of the holding body 22 keeps the fuel injector 20 fixed in a reliable, sealed fashion in the receiving bore 12 of the cylinder head 10. The clamping force 44 ($F_1$) extending in the radial direction and acting in the region of the first pocket-shaped recess 40 also functions as a seal so that in addition to the prestressing of the fuel injector 20 in the receiving bore 12, the expansion sleeve 30 also takes on a sealing function, making it possible to eliminate additional sealing elements.

As has already been mentioned in connection with FIG. 1, it is possible for space reasons for only one pocket-shaped recess 40 or 42 to be provided in the expansion sleeve 30. In this case, the production of one clamping force $F_1$ or $F_2$ is sufficient to fix the holding body 22 of the fuel injector 22 in the receiving bore 12 if the guide surface 68 embodied on the nozzle retaining nut 26 of the fuel injector 20 continues to be guided in the second bore section 18 of the receiving bore 12 in the cylinder head 10.

The two pocket-shaped recesses 40 and 42 in the embodiment shown in FIGS. 1 and 2 can be used to clamp the expansion sleeve 30 in the radial direction inside the receiving bore 12. This radial clamping in accordance with the clamping forces 44 and 46 can be increased by means of the hydraulic fluid so that the clamping is easily able to withstand the axial force exerted by the combustion pressure. The connection can be detached by moving the pressure piston 48 outward in the blind bore 58 of the clamping line 50, which is accompanied by a pressure relief of the expansion sleeve 30. If the circumstances in the region of the receiving bore 12 do not permit a second embodiment of two pocket-shaped recesses 40, 42, then the fuel injector 20 can be guided and centered by means of the guide surface 68 embodied on the nozzle retaining nut 26.

The radial clamping and the accompanying deformation of the wall of the expansion sleeve 30 against the bore wall 14 of the receiving bore 12 make it possible to eliminate the otherwise customary sealing elements for sealing the holding body 22 in the cylinder head cover of the cylinder head 10. Since no additional components such as clamping brackets, flanges, or the like, with the associated fastening screws, are required, the distance between the individual cylinders of an internal combustion engine can be reduced to a minimum or alternatively, the space can be used for other components such as cams of the cam shaft, valves, valve springs for the hydraulic valves, and the like.

The foregoing relates to the preferred exemplary embodiments of the invention, it being understood that other variants and embodiments thereof are possible within the spirit and scope of the invention, the latter being defined by the appended claims.

The invention claimed is:

1. A fuel injector comprising:

a holding body;

a nozzle retaining nut; and an expansion sleeve against which it is possible to act with a hydraulic fluid, wherein the expansion sleeve is used to fasten and center the fuel injector in a fixed fashion in a receiving bore of a cylinder head.

2. The fuel injector as recited in claim 1, wherein the expansion sleeve is fastened to a circumference surface of a holding body of the fuel injector.

3. The fuel injector as recited in claim 1, wherein that the expansion sleeve is integrally fastened to the circumference surface of the holding body at a first attachment site and a second attachment site.

4. The fuel injector as recited in claim 1, wherein at least one pocket-shaped recess is embodied on an inner surface of the expansion sleeve.

5. The fuel injector as recited in claim 4, wherein in a material of the expansion sleeve in the region of the at least one pocket-shaped recess, there is a reduction in a wall thickness of the expansion sleeve.

6. The fuel injector as recited in claim 1, wherein a clamping line for a hydraulic medium is embodied in the holding body of the fuel injector.

7. The fuel injector as recited in claim 6, wherein the clamping line has a blind bore and a conduit, which opens out at a mouth on a circumference surface, inside the region of the circumference surface that is encompassed by the expansion sleeve.

8. The fuel injector as recited in claim 6, wherein a pressure piston that exerts pressure on the hydraulic medium—or relieves the pressure in it—is accommodated in the clamping line.

9. The fuel injector as recited in claim 8, wherein the pressure piston is embodied in the form of a grub screw and has at least one sealing element.

10. The fuel injector as recited in claim 1, wherein with a shortened axial length of the receiving bore in the cylinder head, the nozzle retaining nut of the fuel injector functions as a guide surface for centering and guiding the fuel injector.

* * * * *